US007866114B2

(12) United States Patent
De La Cruz

(10) Patent No.: US 7,866,114 B2
(45) Date of Patent: Jan. 11, 2011

(54) SUPPORT DEVICE FOR REINFORCING MEMBERS IN CONCRETE STRUCTURES

(76) Inventor: Juan Antonio Ferro De La Cruz, Calle trest No. 16, Fraccionamiento Industrial Alce Blanco, C.P. 53370, Naucalpan (MX)

( * ) Notice: Subject to any disclaimer, the term of this patent is extended or adjusted under 35 U.S.C. 154(b) by 335 days.

(21) Appl. No.: 11/885,953

(22) PCT Filed: Mar. 10, 2005

(86) PCT No.: PCT/MX2005/000017

§ 371 (c)(1),
(2), (4) Date: Sep. 7, 2007

(87) PCT Pub. No.: WO2006/096042

PCT Pub. Date: Sep. 14, 2006

(65) Prior Publication Data

US 2008/0134618 A1 Jun. 12, 2008

(51) Int. Cl.
*E04C 5/16* (2006.01)

(52) U.S. Cl. ..... 52/677; 52/687; 52/689; 404/135; 404/136

(58) Field of Classification Search ..... 52/677, 52/687, 689; 404/135, 136
See application file for complete search history.

(56) References Cited

U.S. PATENT DOCUMENTS 3,430,407 A * 3/1969 Berry ..... 52/689
4,682,461 A 7/1987 Sizemore
5,893,252 A * 4/1999 Hardy et al. ..... 52/685
6,663,316 B1 * 12/2003 Harris ..... 404/136
7,108,453 B2 * 9/2006 Harris ..... 404/135
2004/0031228 A1 * 2/2004 Hardy et al. ..... 52/687
2004/0206037 A1 10/2004 Bennett et al.

FOREIGN PATENT DOCUMENTS

| | | | |
|---|---|---|---|
| DE | 2058647 | | 5/1972 |
| EP | 341346 | A2 * | 11/1989 |
| FR | 7144515 | | 7/1972 |
| GB | 779440 | | 7/1957 |
| GB | 2139664 | | 11/1984 |
| GB | 2180275 | | 3/1987 |

* cited by examiner

*Primary Examiner*—Brian E Glessner
*Assistant Examiner*—Joshua Ihezie
(74) *Attorney, Agent, or Firm*—Michael J. Brown

(57) ABSTRACT

This invention is related to a device to separate or out a distance apart structural metallic elements for concrete, between them or in relation to a surface on which concrete is going to be poured, in order to obtain coatings or layers of concrete with specified widths. The chair proposed it is made preferably of propylene and it is made by two vertical walls opposite each other and joined by a third wall orthogonal to the first two (load axis); the vertical opposite walls show on its upper end a semi-circular cavity to support an structural metallic element to be supported, and in its lower part, each one of the walls is divided in three legs, being defined the two on the ends by the vertical edges and a cavity preferably in form of arch between them, and the third being a projection of the transversal wall. All the walls show hollow arches in their lower ends and in some embodiments, preferably for pieces with heights above 2.5 inches, the transversal wall show an upper hollow arch; the cavities permit the pass through of aggregates of concrete.

4 Claims, 19 Drawing Sheets

SUPPORT DEVICE FOR REINFORCING MEMBERS IN CONCRETE STRUCTURES

TECHNICAL FIELD

This invention relates to devices commonly known as chairs, separators or supports of metallic reinforcement elements in reinforced concrete, whose purpose is to establish a separation or spacing among structural elements themselves or between them and the surface of the form, wooden frame or surface on which the concrete is going to be poured or the concrete surface, thereby obtaining the coatings or layers of concrete desired.

BACKGROUND OF THE INVENTION

There is a wide variety of devices intended to support steel reinforced concrete, which will be integrated inside of the concrete. Its purpose is to separate and provide a predetermined spacing (coatings or concrete layers) to those structural elements among each other, between them and the surface of the form or wooden frame, or between them and the surface of the slabs that make the "mold" for "pouring" the concrete, or the form or wooden frame or any other surface that contains the flow of concrete.

Some examples of such devices, "chairs", have been described in numerous patents, of which some examples are presented below, whose teachings form part of the state of the art on which the development of this invention is based:

U.S. Pat. No. 5,595,039 (Lowery, 1997) describes a very simplified support device, of the kind of a solid rod with circular cross section vertically oriented, with its upper end being free and designed in order to a rod can lay on it transversely, and the other end being adjusted to a broad circular support base; the device is intended to support a transverse structural element and it permits spacing to be maintained between that element and the surface on which the device is placed, that distance is equivalent to the total height of the device and, therefore, to the thickness of the coating layer; therefore, the structural element has only one point of support in the device.

The device described in U.S. Pat. No. 4,682,471 (Sizemore, 1987), a chair made of molded plastic elements of different sizes forming the letter "A" between them, functions similarly, with the posts placed divergently with a reinforcement element that crosses on the upper part and another on the lower part. The element of minor dimensions is adjusted through the opening of the major element and fits in its place perpendicularly to the major element by specially designed cavities in the respective transversal elements; in this case, the structural element that lays on the crosshead generated in the upper part of the device also has a point of support, although the device seems to offer a better balance by having four points of support.

In U.S. Pat. No. 6,089,522 (Haslem, et al, 2000) and design patent 421,709 (Haslem, et al, 2000), which refer to the same device, a high chair comprised of four vertical posts joined to one another by a band that runs approximately to half of its height, is described; joint elements are observed between diagonally opposite posts in the upper end, shaping a supporting surface for the structural elements to be supported. The laterals are "H" shaped with their upper ends slightly closer than the lower ends, and the crosshead comprised by the crossbars in the upper part show elements to position the structural element to be supported, so that this element is oriented on one of de diagonals, offering a full line of contact between said structural element and the supporting device (chair); however, to achieve that contact on all the line it is required that the chair be adequately positioned for the diagonal to be collinear with the structural element; otherwise, contact is restricted to only one point.

U.S. Pat. No. 5,729,949 (Hartzheim, 1998) describes a chair used to support and space out meshes of reinforcing bars, wherein it has a cone-shaped hollow body, a flat base that provides great stability, an opening that permits concrete to flow in and around the chair, and pre-shaped notches on the upper part at two levels to keep the bars in the desired position.

US design 334,133 illustrates a chair that has a curved upper end shaped to receive a circular section structural element, the chair rests on four legs with very reduced contact zones and shows a reinforcing ring in the proximity to its base.

SUMMARY OF THE INVENTION

In view of limitations and problems presented by developments proposed in the previous art up to now, an objective of this invention is to provide an element of support for a metallic structure of the type known as a chair, with a structural design that permits achieving a great load capacity.

Another objective of this invention is to provide a chair, whose base is equipped with lower extremities or legs whose distribution and shape assure significant stability of the chair itself, as well as of the metallic structure that it supports.

Still another objective of this invention is to provide an improved chair, whose shape assures optimum behavior with concrete and its aggregates, thereby permitting passage of those aggregates and optimum integration into the structure.

Another objective of this invention is to provide a chair that offers two points of support for steel; the chair then, by acting as a double separator, offers advantages of stability with respect to those of the state of the art.

Another objective of this invention yet, is to provide a chair on which its structure is shaped and reinforced in such a way that there is a load axis between the two points of support that permits achieving greater load capacity, assuring that the reinforcing steel for the concrete is maintained aligned on the load axis, maximum resistance is achieved and assures that the assembly will maintain its position.

Another objective of this invention is to provide a chair on which the load area of the separator is greater than any separator with a point of support, by possessing two points of support situated longitudinally, thereby achieving greater productivity by achieving better performance per square meter.

These and other objectives and advantages of this invention will become evident from the following description, which is accompanied by a series of Figures for the preferred embodiments of the invention that should be understood, are drawn up for illustrative but not limitative purposes of the teachings of the invention.

BRIEF DESCRIPTION OF THE INVENTION

In accordance with this invention, the main purpose of the chair is to serve as a support and separator of steel reinforcement conventionally used to shape concrete slabs. The chair is shaped by a single piece that includes a body with two upper ends and a plurality of supporting elements or elongated legs aligned in two parallel rows with one another to both sides of the main body, the legs actually constitute the body of the device and extend from the upper end in contact with the steel downwards, thereby forming the base of the device that will be in contact with the concrete contention surface, form or wooden frame, the thickness of the concrete coatings is then established by the distance from the point of contact with reinforcing steel to the lower end of the legs or bases, that is, by the height of the device.

There can be various alternatives in the arrangement of the supporting elements of the chair of the invention, the preferred embodiments are illustrated in this description in which it should be noted that the legs of the chairs are preferably four-sided structures that are reduced toward the lower part, ending in a sharpened figure with little contact surface, but in cases in which the load is notable, the legs have a cross section that is essentially shaped like a cross, that gives high resistance, and since greater resistance against deformation is successfully achieved with the same quantity of material, thereby offering greater resistance to the load; in all cases, the main body is formed by the two walls that form the sets of legs which are connected by another transverse wall to the first two walls; on their upper ends are located cavities shaped to receive the elongated elements of the metallic structure to be supported. These supporting cavities are essentially concave, semi-circular, and appropriate for receiving the profile of the steel structural elements, so as to offer the greatest possible area of contact between the body of the chair and the metallic structure.

In some of the tallest chair embodiments, the intermediate wall takes an "H" form, and the arch-shaped cavities permit the passage of concrete through it, and they also permit structural elements oriented transversely to be supported, by going through the cavities if so desired.

Some advantages of the proposed device that will be evident for a person knowledgeable in the area include the following:

- It is a stronger, more stable and easy to install device with greater efficiency per square meter.
- Its weight in plastic vs. load capacity ratio is better. Consequently, it is more productive, since the preferred material for manufacturing it is polypropylene which offers high resistance with a low investment of material.
- In addition to separating, wedging or giving the projected or expected position to the reinforcing steel, by having six extremities or legs and two points of support for the steel on the same axis, great stability is achieved by maintaining itself in the position in which it is placed.
- Its structure assures great load capacity.
- Its functioning and behavior in concrete are optimum, even with very thick aggregates and steel up to a 1.5 inch diameter.

DETAILED DESCRIPTION OF THE INVENTION

The following description will refer to the attached drawings described above, that should be understood as illustrative of a preferred embodiment of the invention and not limited to the scope of the inventive matter. The common elements in the Figures have the same numerical references in all of them.

Figure 1:
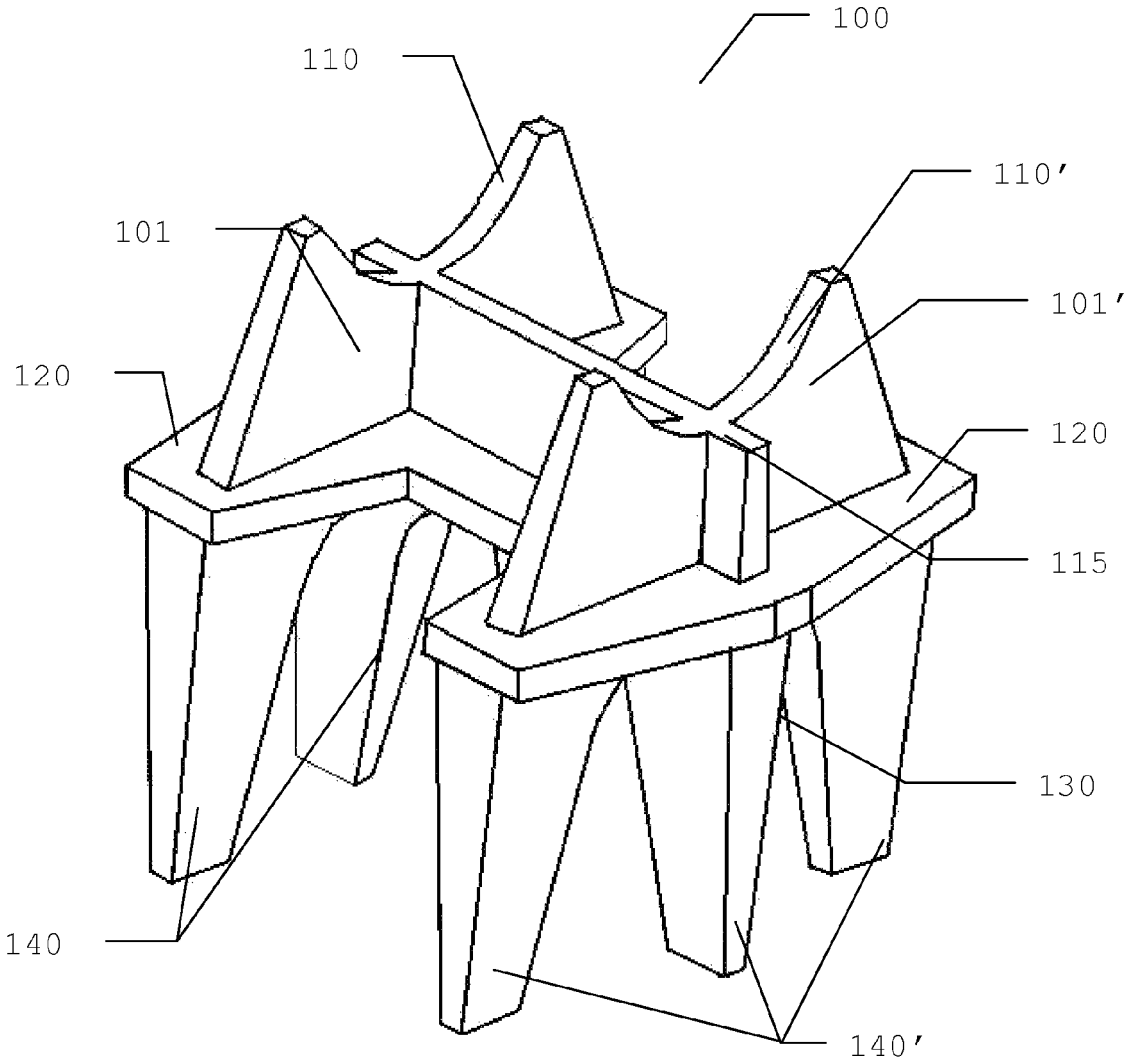
FIG. 1 is a simple perspective view from a point above the upper plane of a first embodiment of the chair of the invention, preferred for spaced out distances ranging between 0.75 and 2.5 inches.

The chair, support or vertical plastic separator, subject matter of this invention, is a device designed to wedge or space reinforcing steel uniformly at different heights in reinforced concrete structures, thereby assuring the position of the steel and the projected concrete coverings, as well as achieving correct structural functioning. FIG. 1 illustrates a preferred embodiment of the device of the invention, referred to henceforth as "chair" (100).

The chair (100) functions as a double chair, since it has two points of support of steel (110) and (110') on the same axis (115), which results in greater strength and better stability, thereby achieving the projected concrete coatings accurately.

The device (100) has a series of advantages with respect to the devices described in the previous art. The clearest advantages encompass offering greater load capacity and greater performance, as well as reducing structural failures for erroneously placed steel, and avoid variations in projected concrete coatings, which are their two basic functions.

Since it is manufactured from plastic materials, basically polypropylene due to low costs, properties, availability, and knowledge of associated processes, although it could be manufactures on a similar fashion from other plastic resins employing the same injection molded technique, it is desired to avoid the use of waste materials which promote the diminishing of the useful life due to pollution and corrosion thereof.

Performance and efficiency per square meter of the proposed device is better than those of other accessories used for the same purposes, thereby reducing costs.

By returning to FIG. 1, the complete structure can be observed of the illustrated chair incorporating the teachings of this invention.

The chair (100) has a main body comprised of two vertical walls parallel to one another (101) and (101'), joined by a transversal wall (130) and a reinforcing horizontal surface (120). Vertical walls (101) and (101') are built by joining a plurality of vertical elements or legs (140) and (140') that extend from the base of the chair (100) to its upper ends (110) and (110'); the walls in all embodiments illustrated present an essentially polygonal form, preferably hexagonal with its upper and lower sides parallel to one another and horizontal with respect to the floor when the chair is in a position of use; the angle of the vertically inclined sides depends on the height of the metallic structure with respect to the floor, as well as the desired width of the chair as a whole, width and height maintain a proportionate ratio in the range from 30% to 60%, so as not to alter its stability. All modalities illustrated differ from one another, due basically to the heights and disposition of the angles of those walls, as can be observed in the following Figures and description. In the first embodiment illustrated, the sides inclined next to the base of the walls (101) and (101') are essentially vertical.

Figure 7:
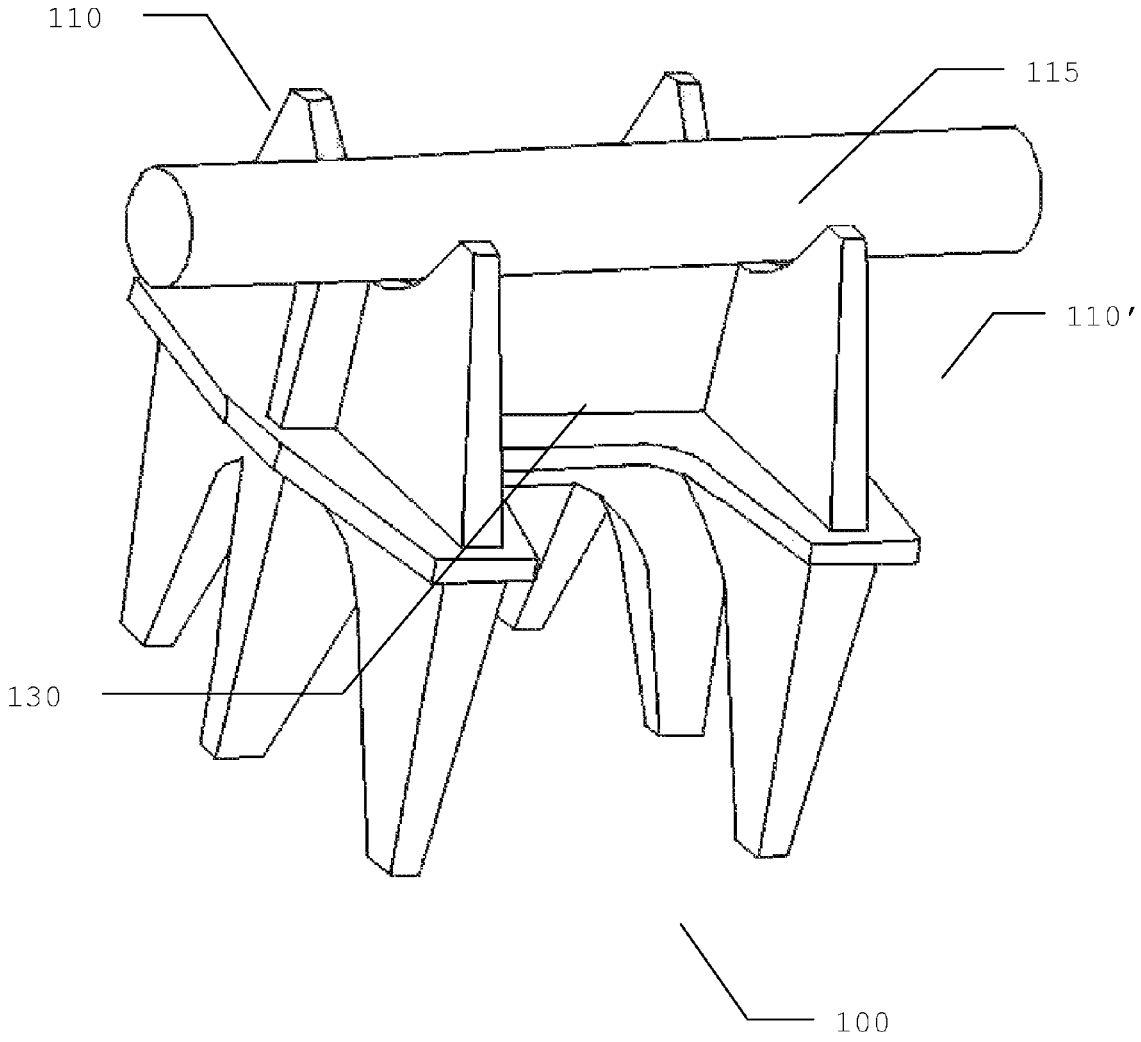
FIG. 7 is a simple perspective view of the first embodiment of the chair of the invention in its position of use with a load element in its place.

In the upper end of the vertical walls (101) and (101'), semi-circular cavities (110) and (110') are observed that are intended to receive and accommodate an enlarged element of the metallic structure to be supported. The two semi-circular cavities are aligned with one another, so that a steel structural element can lay on both cavities as shown in FIG. 7. In its lower part, the vertical walls (101) and (101') present a hollow arch (125) that properly defines the plurality of chair legs, preferably that these walls form two pairs of legs aligned with one another, starting from the lower inclined sides of those vertical walls (101) and (101').

The vertical walls (101) and (101') are maintained equally distant and aligned to one another by a third joining wall (130) located transversely to the other two and aligned with the plane that joins the symmetry axes thereof. Geometry of this third wall (130) is similar to that of the other two (101) and (101'), since their external inclined sides form the central leg of the plurality of legs (140) and (140'); just like the other vertical walls, the wall (130) shows an arch (135) on its lower end of a height similar to the arches of the other walls, although the width is proportionate to the height.

Figure 2:
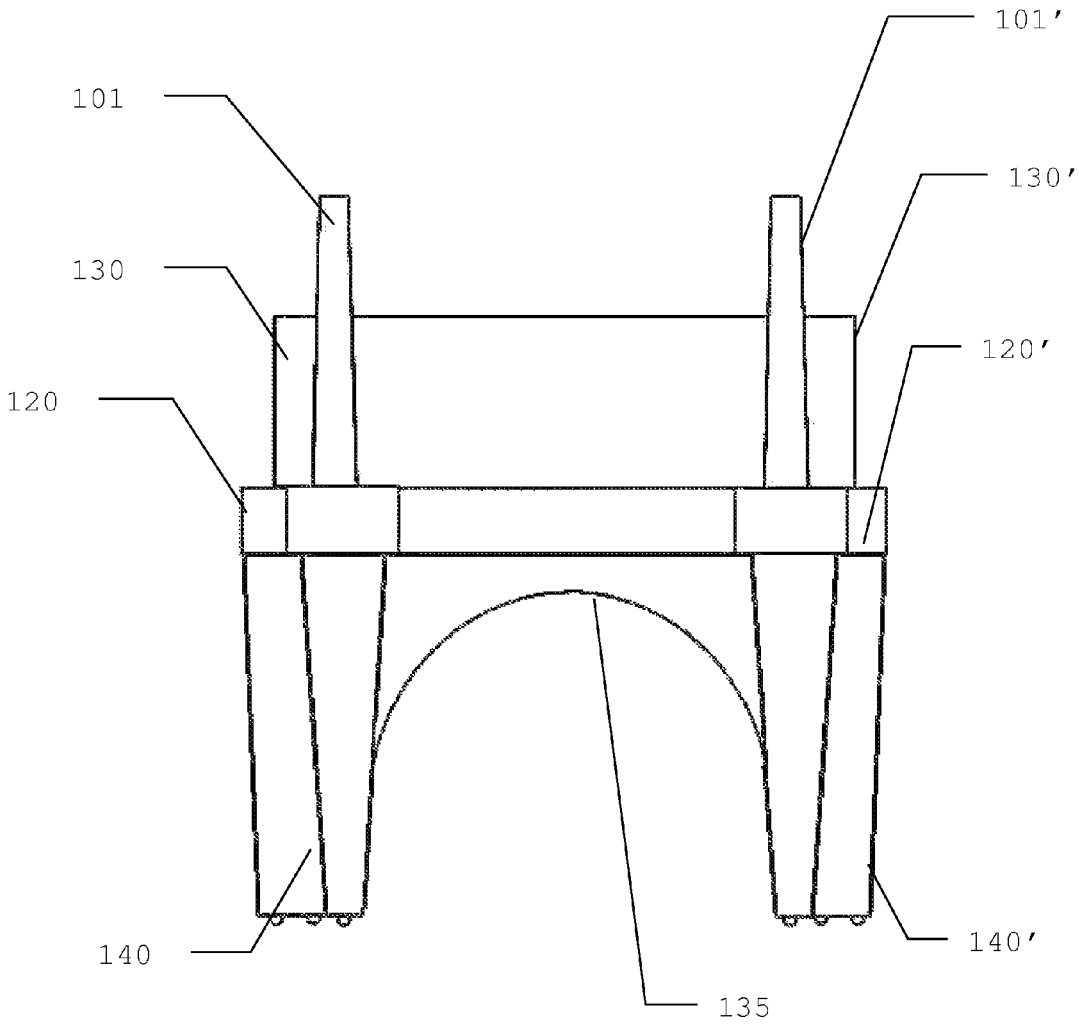
FIG. 2 is a front view of the first embodiment of the chair of the invention.

On the upper end, the wall (130) can show different configurations, pursuant to the total height of the chair, as shown in the pertinent Figures; in the embodiment described and due to the low height of the overall device, the wall (130) presents a straight edge that joins the low points of the cavities (110) and (110') and is even projected beyond the walls (101) and (101'), as observed in FIG. 2; this allows the supported structural element to have a complete line of contact, and the presence of this wall does not impede the concrete aggregates from being able to accommodate themselves adequately, due to the presence of other cavities (122) and (124) on the horizontal reinforcing surface (120).

Figure 3:
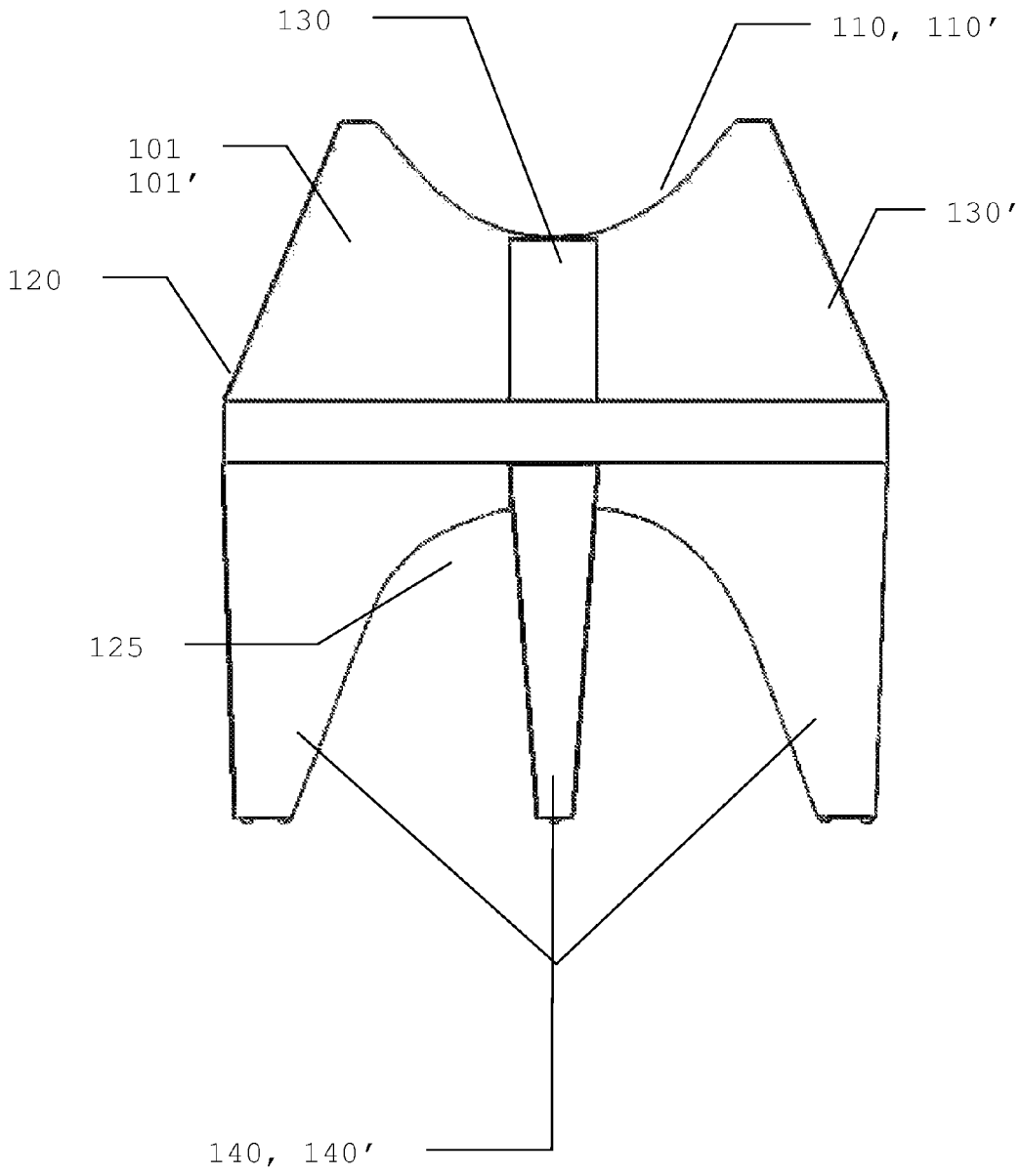
FIG. 3 is a lateral view of the first embodiment of the chair of the invention.

FIGS. 2 and 3 show frontal and lateral views (with respect to the wall (130)) where the geometric configurations of the walls (101), (101'), and (130), as well as the cavities and arches of those walls are observed better.

Figure 4:
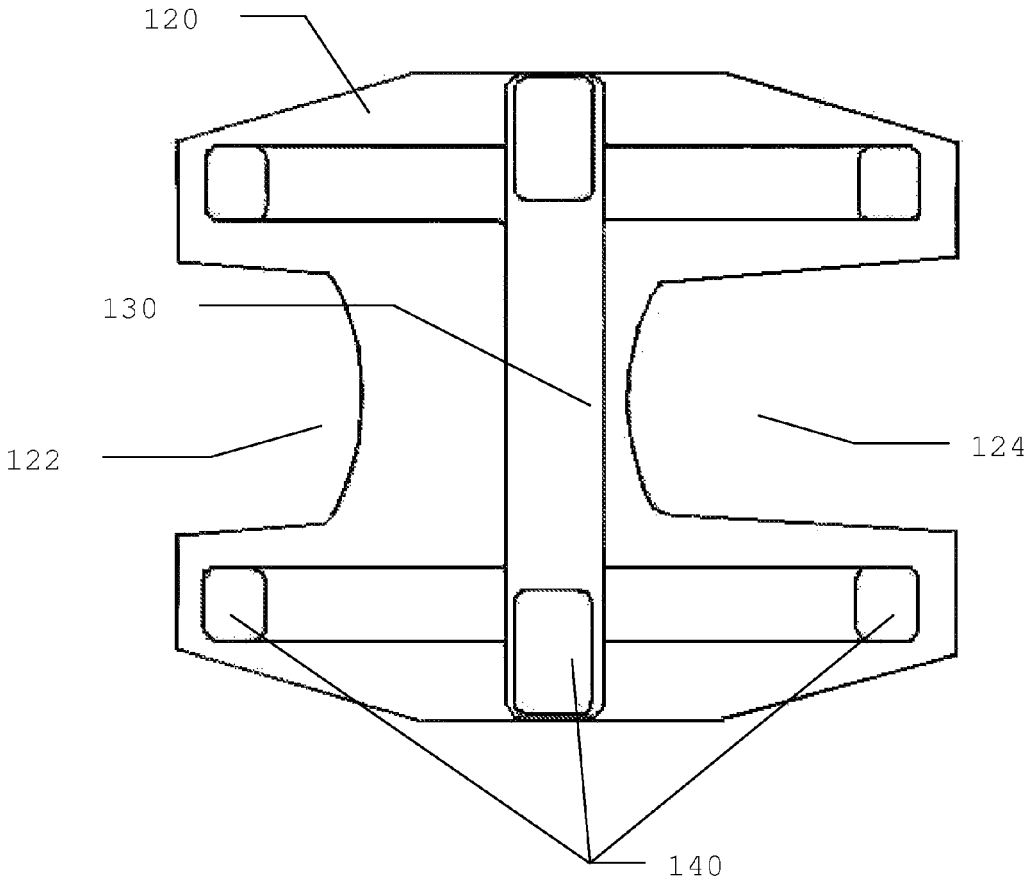
FIG. 4 is a low plane view of the first embodiment of the chair of the invention.

FIG. 4 is a low view of the chair (100) in which it is possible to observe the form of the transversal section of the "legs" (140) and (140') (although this numeral is not shown, note that the figure is symmetrical), which are practically quadrangular and solid.

Figure 5:
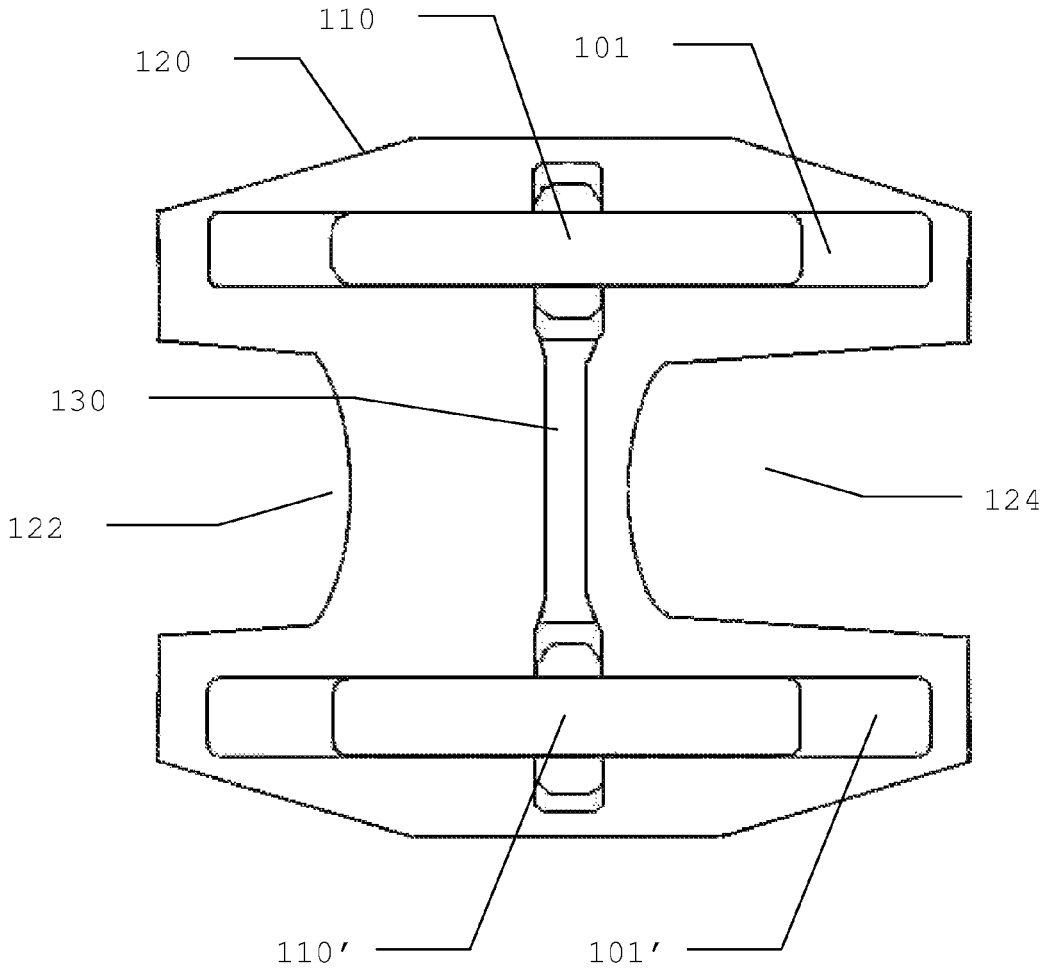
FIG. 5 is a high plane view of the first embodiment of the chair of the invention.

FIG. 5 is an upper view of the chair (100) that schematically illustrates the changes of width of the vertical walls and contact areas between the chair (100) and the elements of the metallic structures to be supported in the semi-circular cavities of the upper ends (110), (110'), and the cavity of the transversal wall (130) (shown in degraded tones to give an idea of the curvature).

Figure 6:
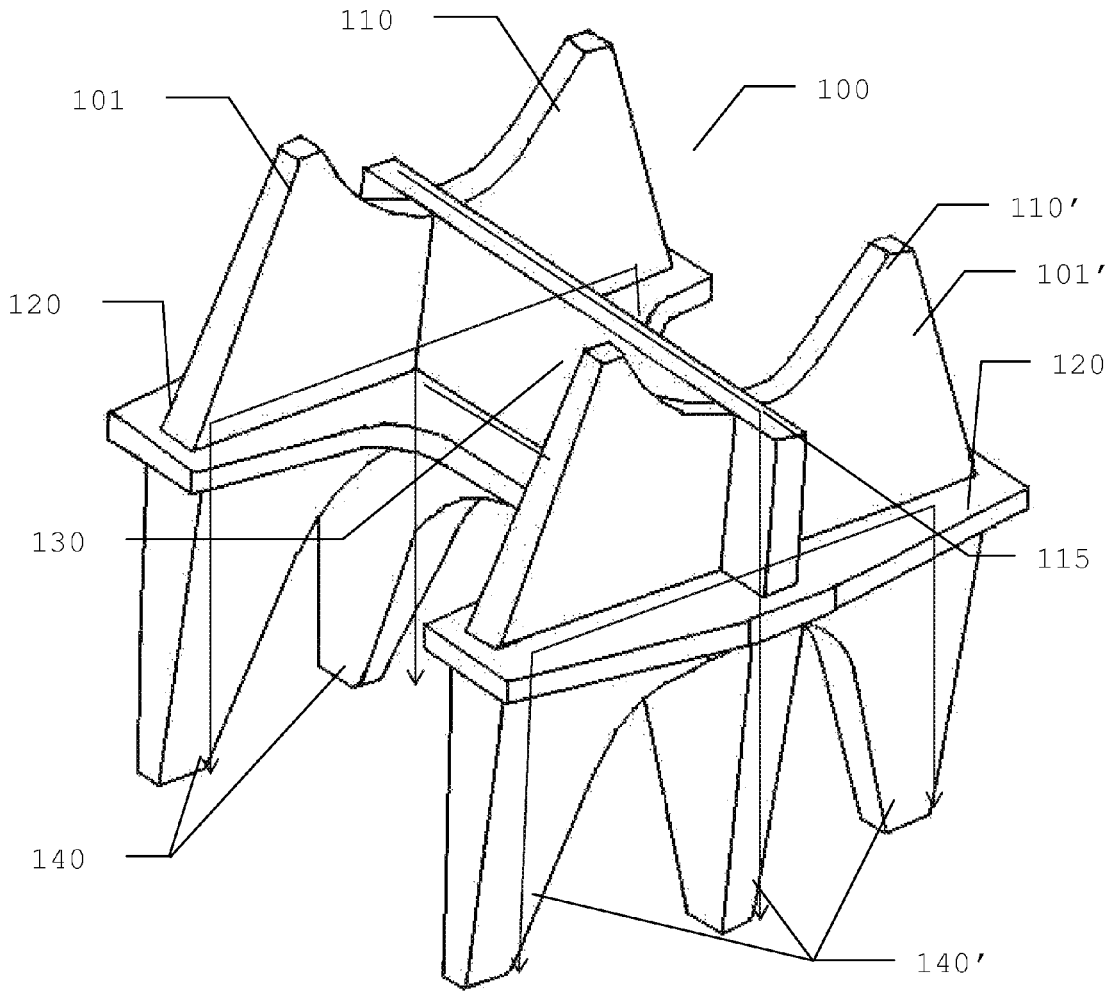
FIG. 6 is a simple perspective view of the chair of the first embodiment of the invention, which shows a diagram of the distribution of loads through the body of the chair.

FIG. 6 is intended to show how the configuration of the chair of this invention distributes the load stresses from the points of contact on the semi-circular cavities (110) and (110') through the load axis (115) toward the walls (101), (101'), and (130), and finally to the points of contact of the legs (140) and (140') with the surface of reference, and eventually the form or wooden frame.

FIG. 7 shows a chair (100) of the invention in accordance with the recently described embodiment, carrying a structural element of the type of a steel rod, for example, of a round section, which lays on the cavities (110) and (110'), and on the upper edge of the wall (130) that coincides of the load axis (115); note that although the semi-circular cavities (110) and (110') present a form similar to the section of the structural element, they should not necessarily be adjusted to the periphery thereof, and it should suffice that the weight of that structural element is concentrated on the points of contact intended for it on the semi-circular cavities, thereby successfully distributing the stresses illustrated in FIG. 6.

Figure 8:
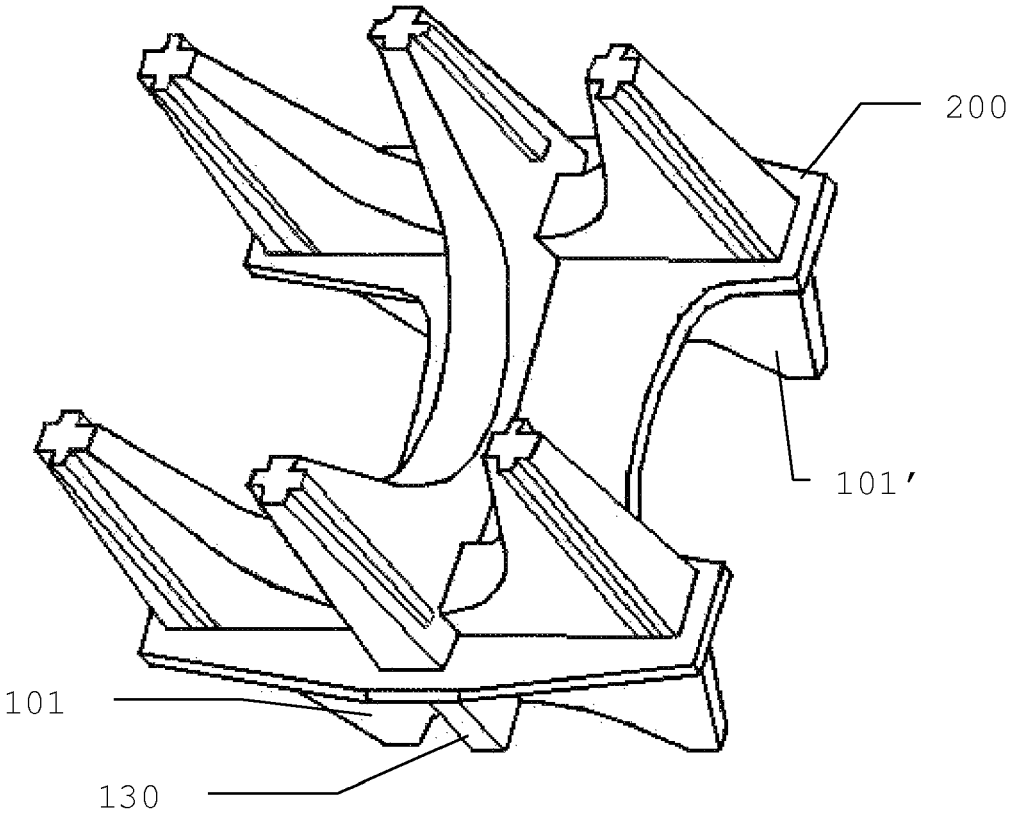
FIG. 8 is a simple perspective view of an alternate embodiment of the chair of the invention of the above figures from a point above the upper plane, in which the section of the legs shows a cross section appropriate for supporting higher stresses.

In an alternative of the first modality that has been shown in previous figures, illustrated in FIG. 8, the walls of the legs have been reinforced to give a cross section that allows for applying greater stresses on the assembly of the chair. This practice of including reinforcing ribs or panels is applied to the basic structure illustrated in FIGS. 1 to 7 when the chair of the invention is used in adequate embodiments at greater distances and loads, as illustrated in the following Figures and description.

Figure 9:
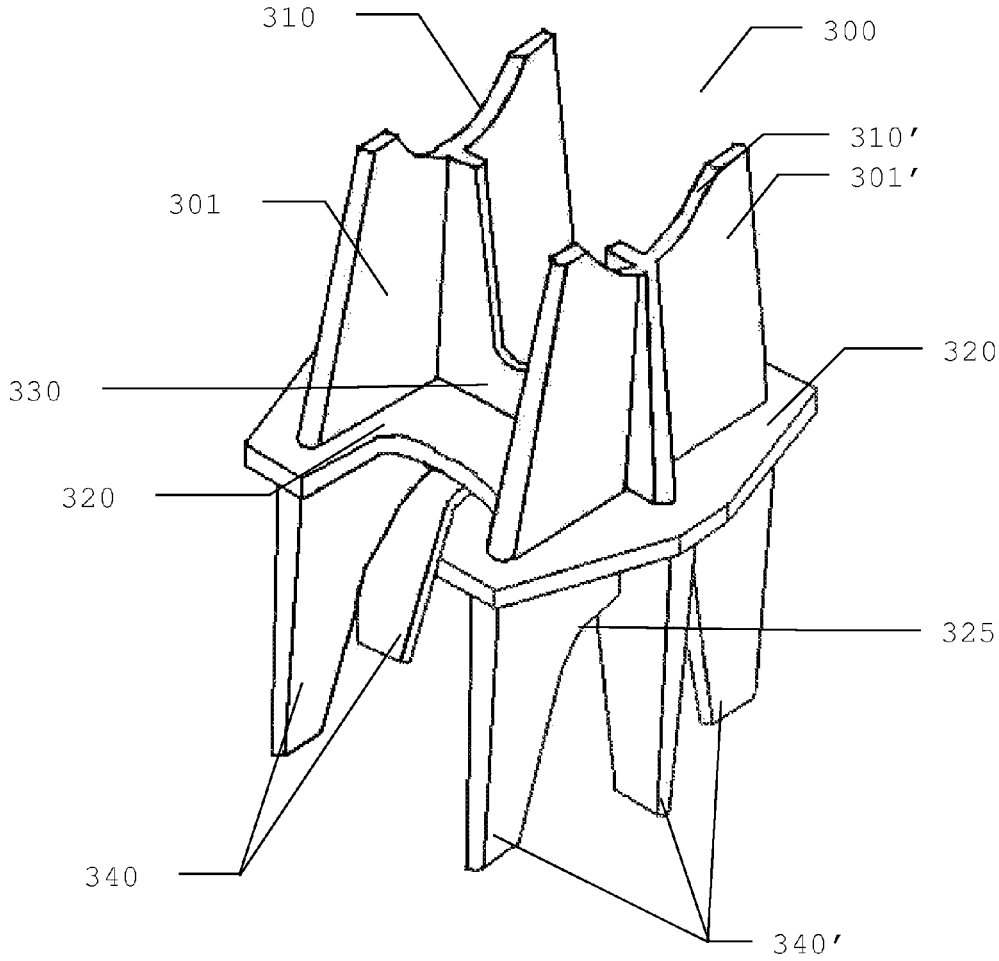
FIG. 9 is perspective view of a second embodiment of the chair of the invention that applies to the chair preferred for spaced heights ranging between 3 and up to 4 inches.
Figure 10:
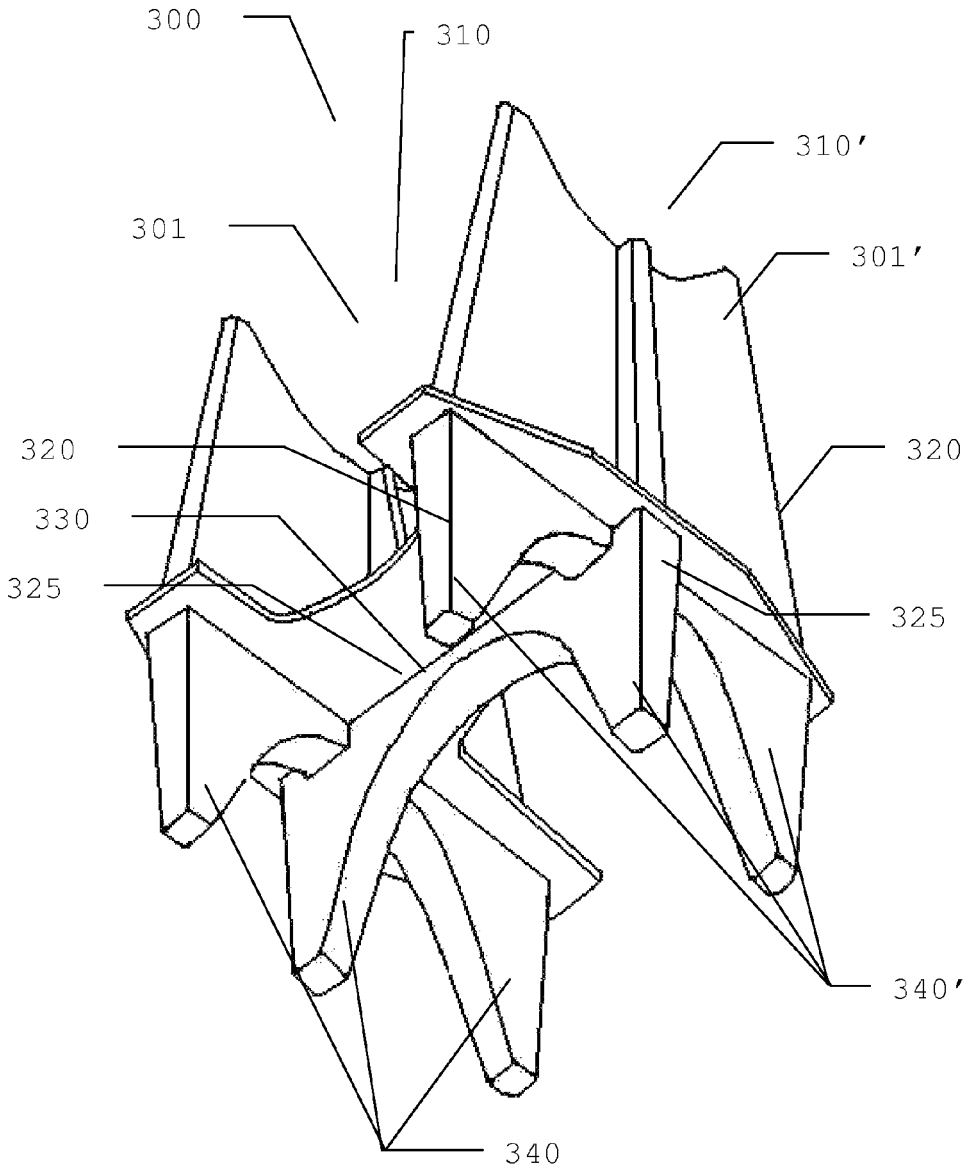
FIG. 10 is a simple perspective view of the second embodiment of the chair of the invention of FIG. 9, from a point below the low plane.
Figure 11:
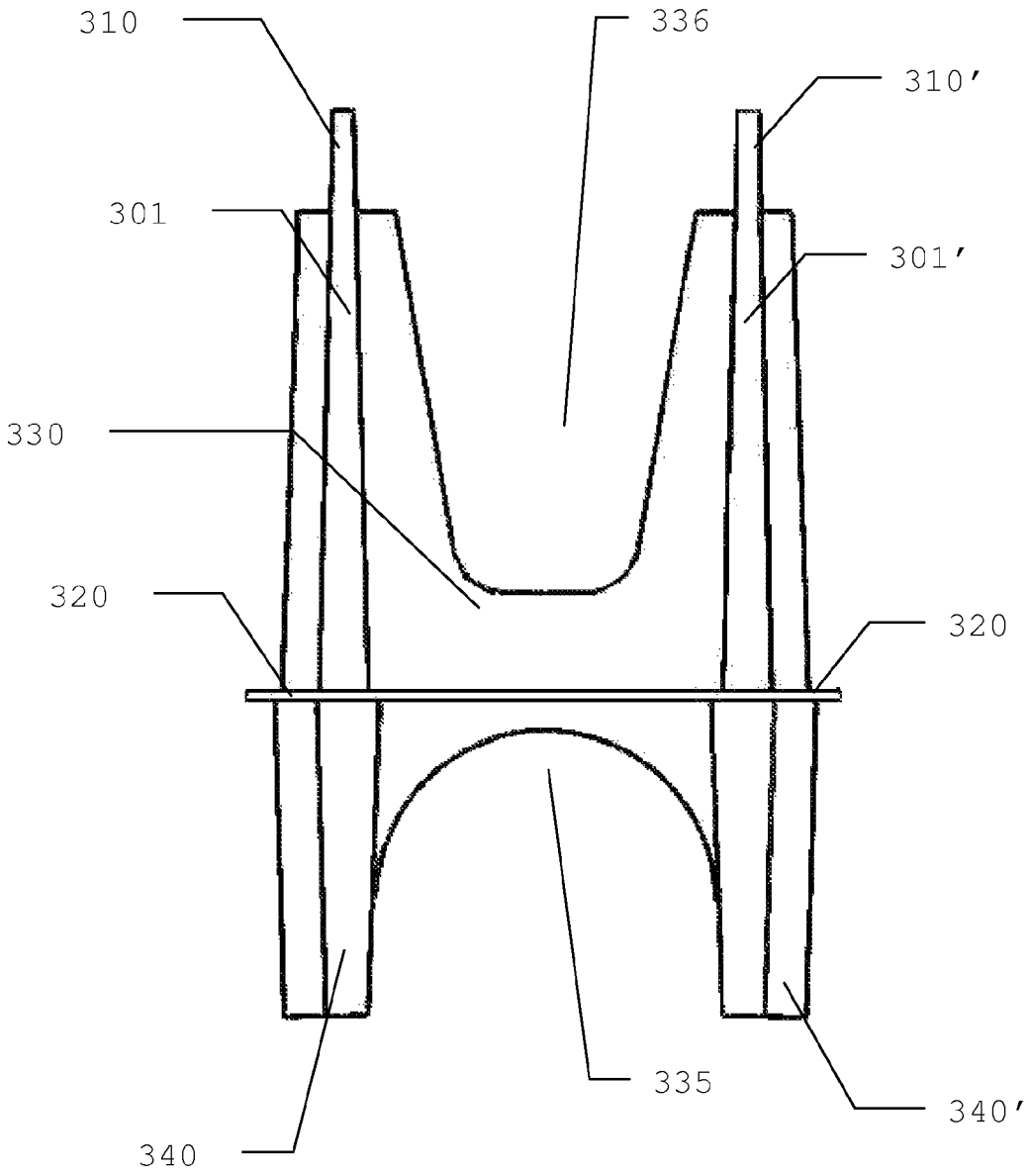
FIG. 11 is a front view of the second embodiment of the chair of the invention.
Figure 12:
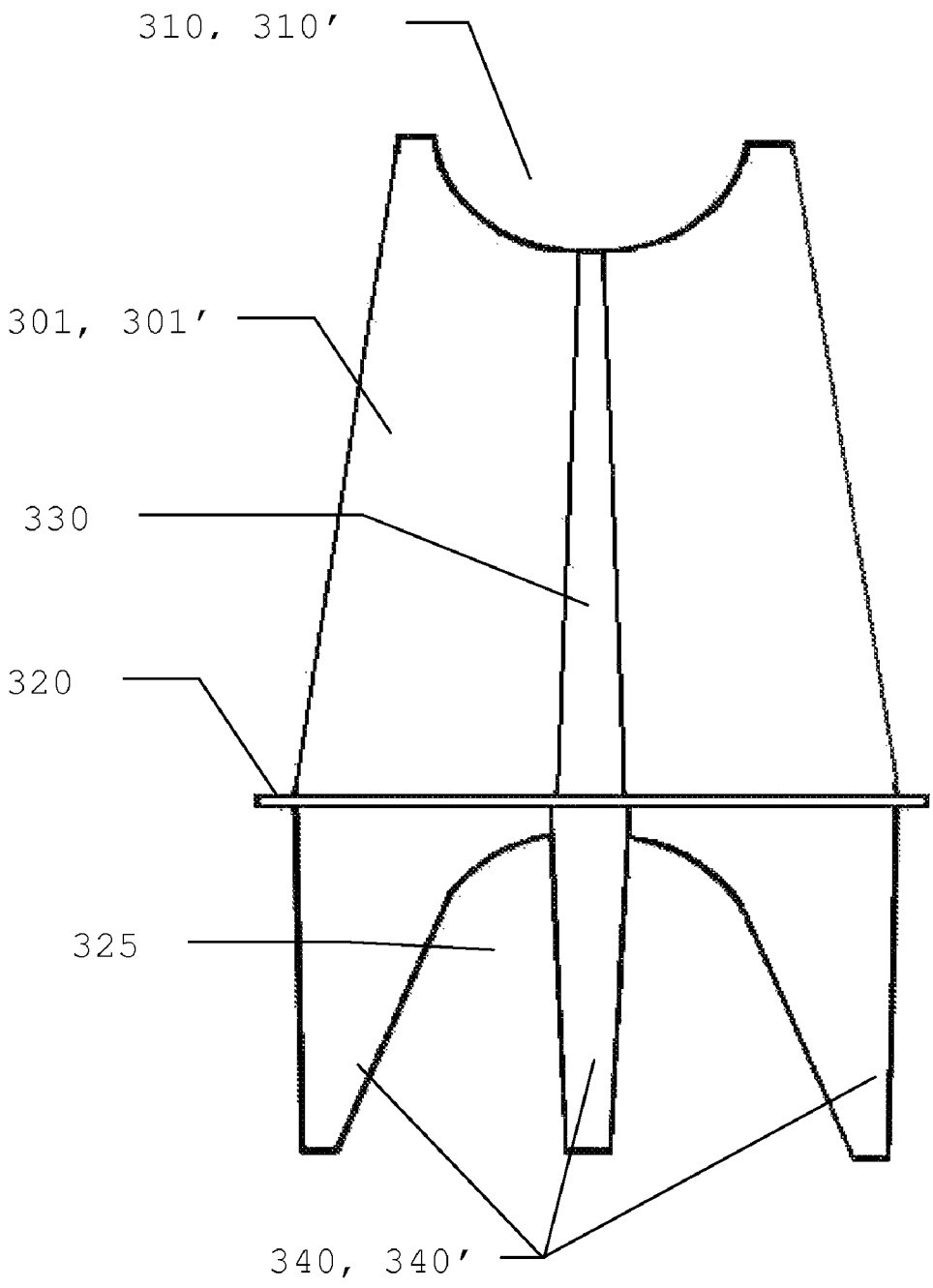
FIG. 12 is a lateral view of the second embodiments of the chair of the invention.

FIGS. 9 and 10 show a view in an upper and lower perspective of an alternative embodiment of the chair of the invention denoted by (300), which is the preferred embodiment for distances ranging from 3 up to 4 inches. This embodiment presents the same fundamental characteristics of the embodiment described in the first place, by having two vertical walls (301) and (301') basically hexagonal with semi-circular cavities (310) and (310') on the upper edges intended to house the structural steel elements, lower hollow arches (325) that comprise the legs (340), (340'), and those on which the lower inclined walls are practically vertical.

FIGS. 13 and 14 again illustrate the use of reinforcing the basic model from FIGS. 9 to 12 to offer greater space ranging from 4.5 inches and more. In this embodiment, the vertical sides of the device are made from straighter, more vertical profiles and reinforcing elements are added to the sides of those walls in the form of triangular supports that stiffen the complete structure without increasing the mass of plastic used excessively.

In the preferred embodiments for distances exceeding 3 inches shown in FIGS. 9 to 19, the joining wall (330), (430) presents a cavity (336), (436) that extends downward until it is given a form similar to an "H", although observations shows that both the upper (336), (436) and lower (335), (435) cavities have their inclined interior sides that become thinner in upward and downward directions, respectively. This pronounced concavity allows concrete aggregates to enter and elements of the metallic structure, in some cases, which are transversal to the elements that could be supported on the cavities (310), (310'), (410), (410') of the vertical walls (310), (310'), (401), and (401').

Figure 13:
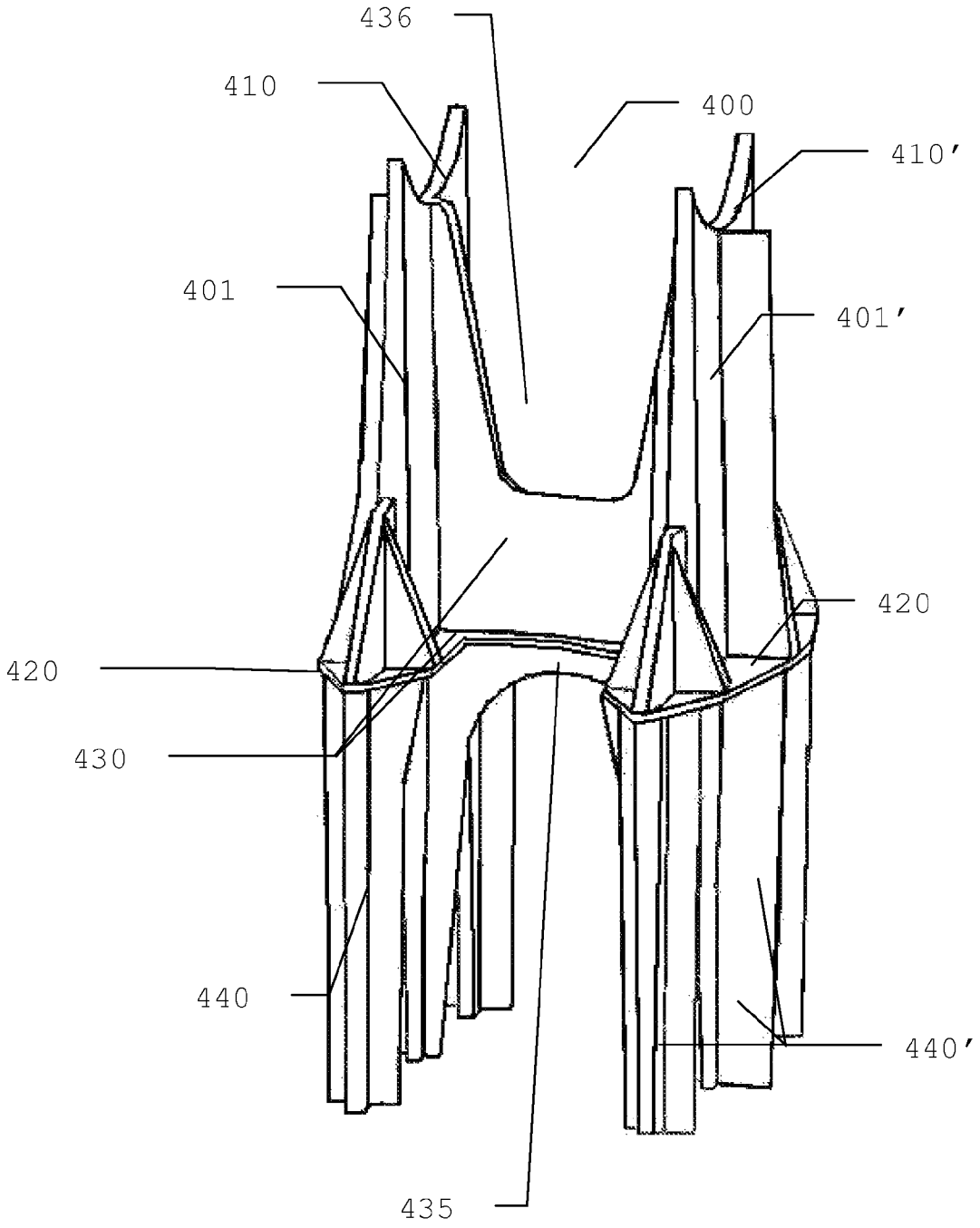
FIG. 13 is a simple perspective view of a third embodiment of the chair of the invention that is preferred for heights spaced more than 4.5 inches.
Figure 14:
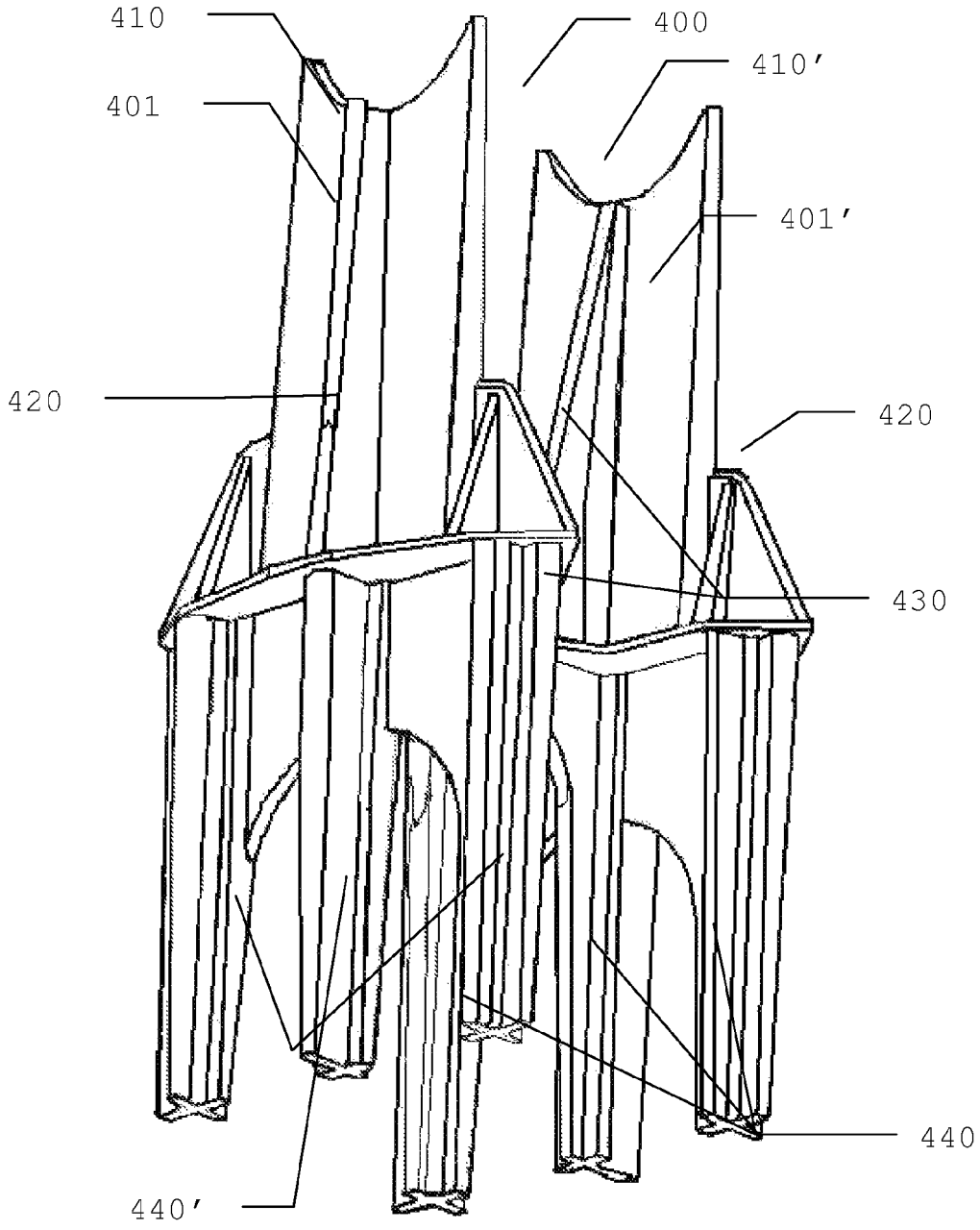
FIG. 14 is a simple perspective view from a point below the low plane of the third embodiment of the chair of the invention.
Figure 15:
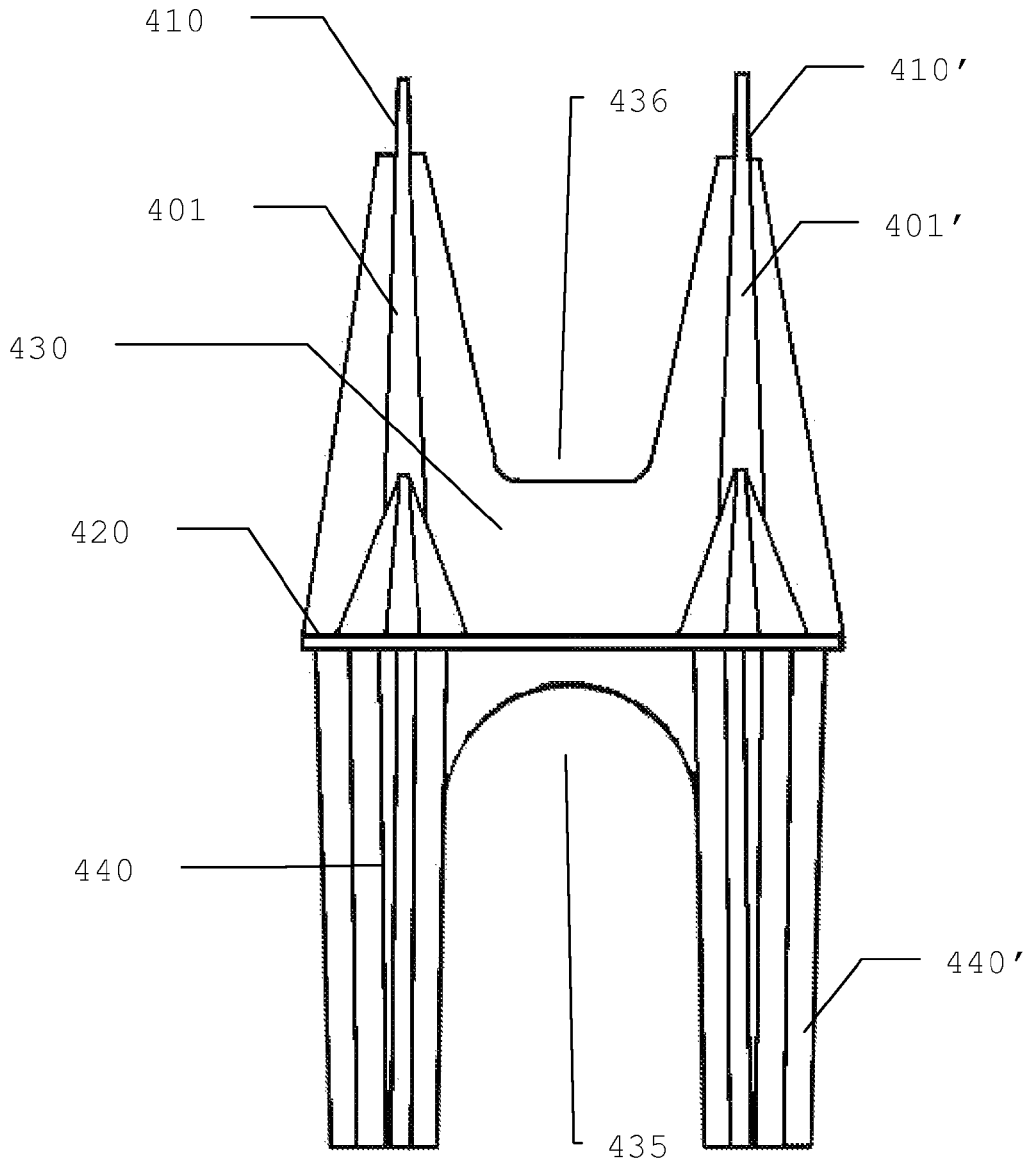
FIG. 15 is a front view of the third embodiment of the chair of the invention.
Figure 16:
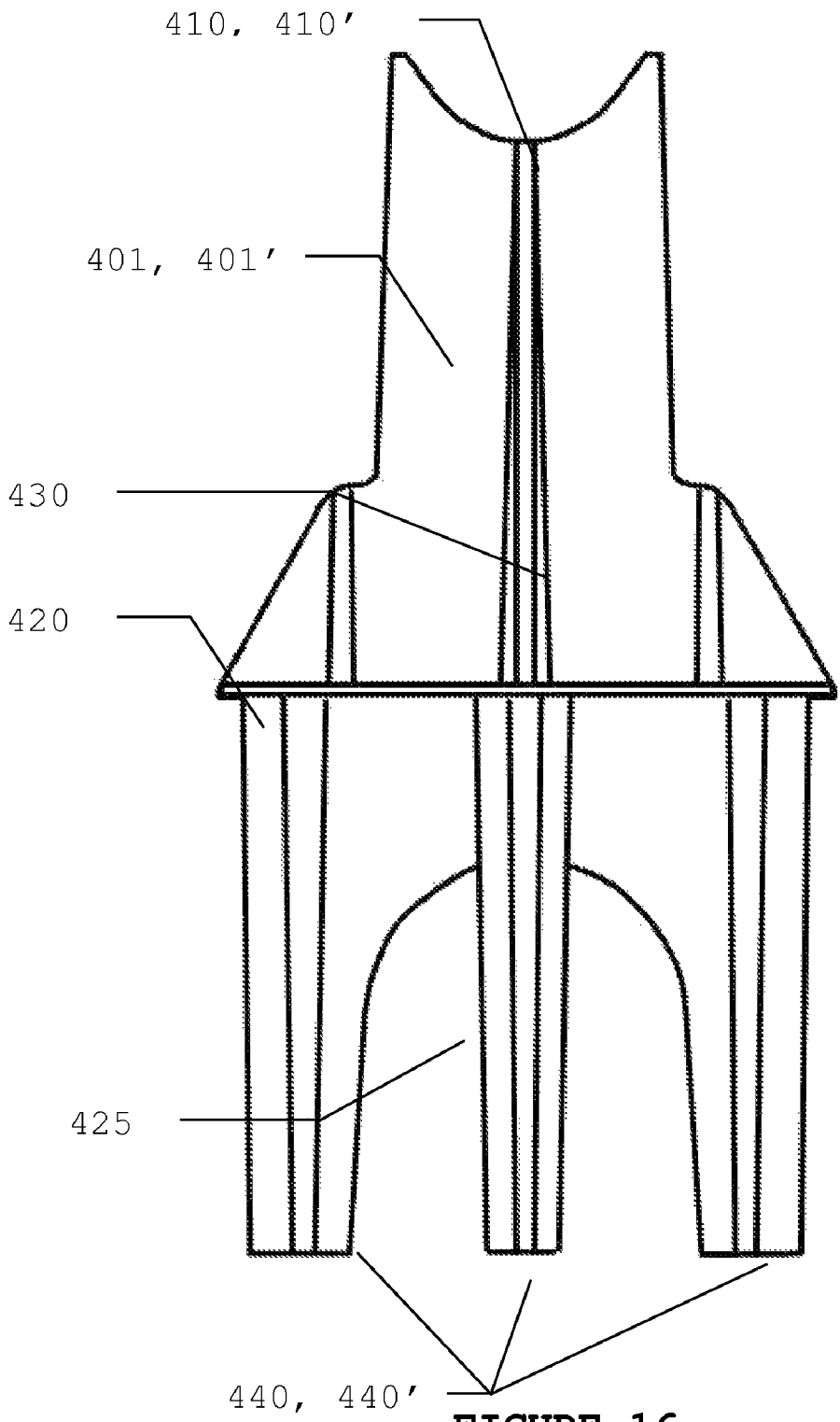
FIG. 16 is a lateral view of the third embodiment of the chair of the invention.

Returning to the embodiment of FIG. 13 and subsequent, FIG. 15 shows a front view of the chair (400) where the retirement of material from the upper (436) and lower (435) arches of the wall (430) becomes evident, which serves mainly to permit the passage of concrete aggregates; the whole piece (400) offers little volume for spreading concrete through the multiple cavities and the thinness of their elements comprising it, however, they provide high stiffness and stability to the assembly, due to the predominant pyramidal form in all of them.

Figure 18:
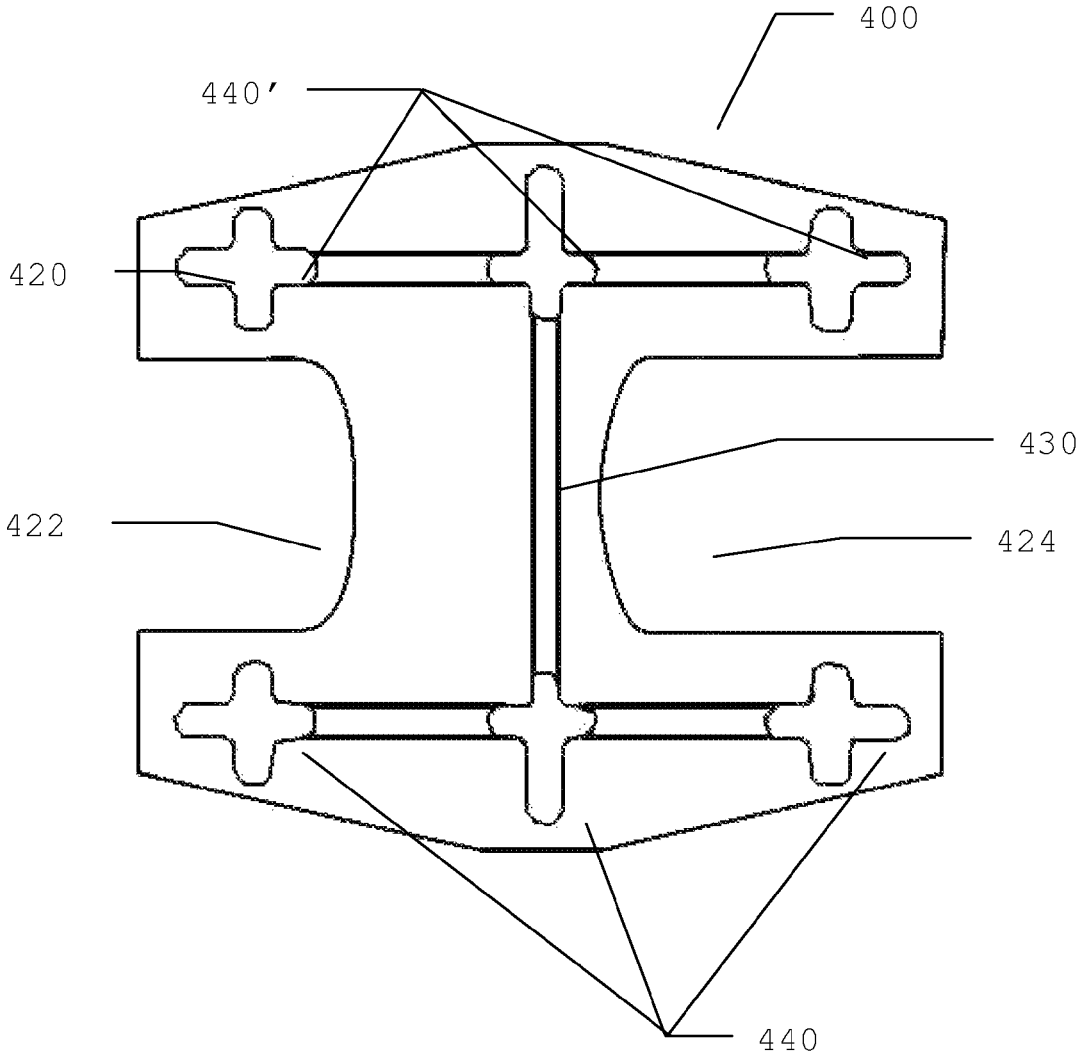
FIG. 18 is a low plane view of the third embodiment of the chair of the invention that shows the detail of the cross section of the legs.

FIG. 18 is a low view of the chair (400) where it is possible to observe the form of the transversal section of the "legs" (440) and (440') that have the form of a cross, since it provides great stability and greater bearing capacity to the assembly, as discussed above.

Figure 17:
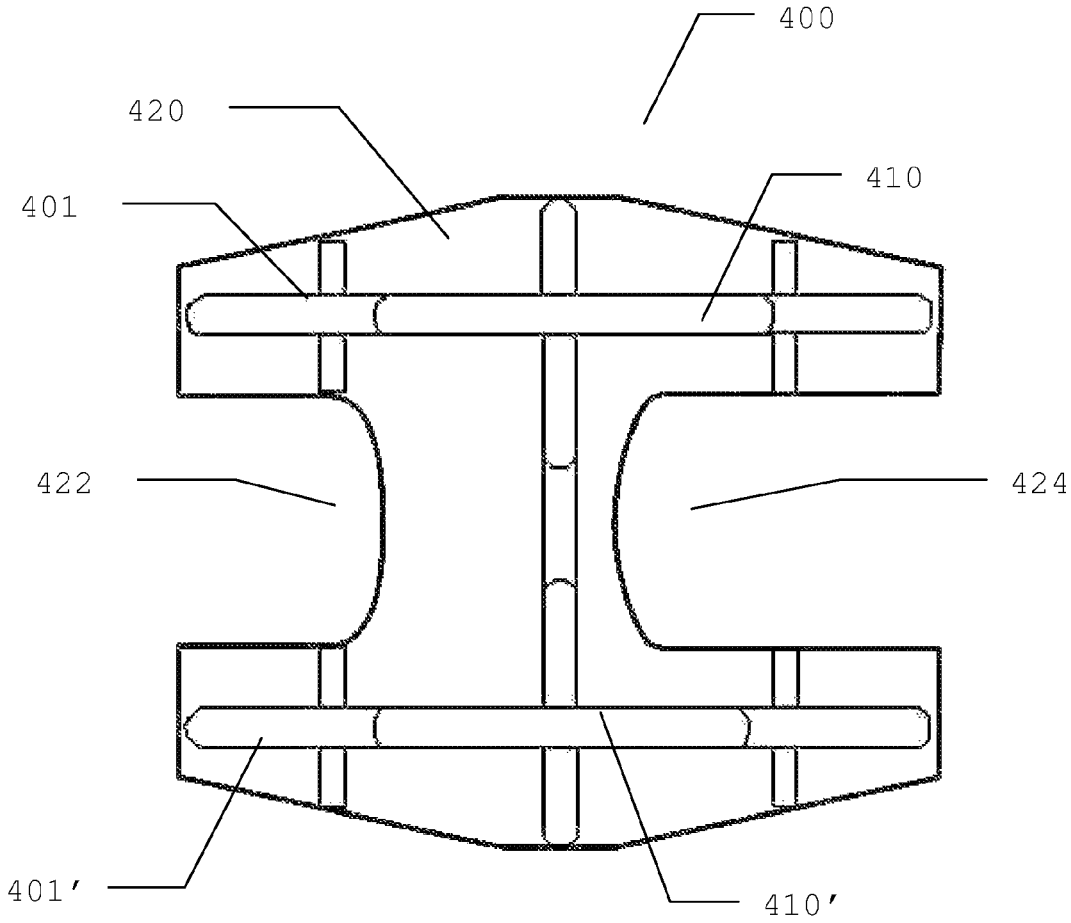
FIG. 17 is a high plane view of the third embodiment of the chair of the invention.

FIG. 17 is included here to evidence the pyramidal elements that extend upward until topping out on the semicircular cavities (410) and (410') that receive the structural element to be supported.

Figure 19:
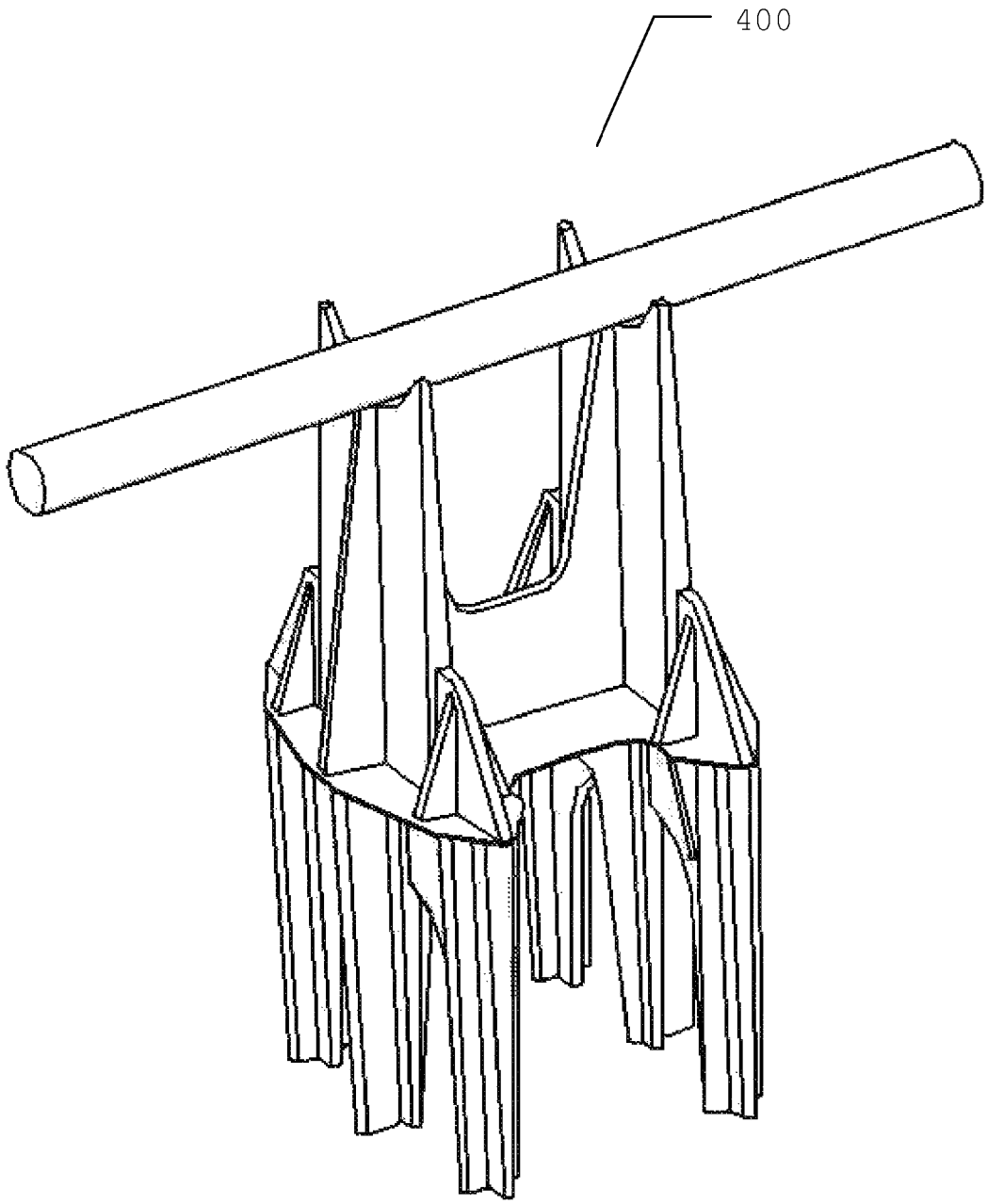
FIG. 19 is a view in a simple perspective of the third embodiment of the chair of the invention in its position of use with a load element in its place.

Finally, FIG. 19 shows the chair (400) of the preferred embodiment for significant loads and heights exceeding 4 inches, in its position of use with a structural element put in its place.

The description that has been made of some of the preferred embodiments of this invention makes it clear that changes can be made to the geometric configuration device, however, those changes that can be evident for a person with average knowledge of the subject matter will be understood to be included in the scope of this invention, which is defined by the following claims.

Once the invention is described, which is considered novel and, therefore, its ownership is claimed is as follows:

1. A device to separate or space out metallic structural elements for reinforcing concrete from each other and from the surface on which the concrete is going to be poured, wherein the device is formed by two opposite vertical walls joined to one another by a third transverse vertical wall, and a horizontal reinforcing surface dividing the device in an upper section for receiving the metallic structural elements and a lower section with a plurality of support legs; each one of the opposite vertical walls presenting a semi-circular cavity on their upper edge formed to receive a metallic structural element to be supported; and in its lower part, each one of the two opposite vertical walls is divided into two legs defined by outside edges of the vertical walls and an arched cavity between them, and a third intermediate leg is formed by a projection of the third transverse vertical wall; the third transverse vertical wall extending upwardly to the lowest point of the semicircular cavities, where the upper edge of the third transverse vertical wall supports the structural element as well; the load of the structural element being distributed along the upper edge of the third wall, as load axis, toward the vertical walls of the device, and is finally concentrated on the contact surfaces of the three legs.

2. A chair according to claim 1 wherein the pieces more than 2.5 inches high, the transversal wall also presents an upper hollow arch that is provided for permitting concrete aggregates or, if applicable, transversal structural elements to pass through freely.

3. A chair according to claim 1 wherein the legs of the vertical walls preferably have an essentially quadrangular solid cross section of the area when that chair has a height of up to 4 inches.

4. A chair according to claim 1 wherein the legs of the vertical walls preferably have an essentially cross shaped solid cross section of the area when that chair has a height of up to 4 inches or is intended to support significant loads.

* * * * *